US007252564B1

(12) United States Patent
Morello et al.

(10) Patent No.: US 7,252,564 B1
(45) Date of Patent: Aug. 7, 2007

(54) FEMALE ELECTRICAL CONNECTOR HAVING CRIMPING PORTIONS OF DOUBLE THICKNESS

(75) Inventors: John R. Morello, Warren, OH (US); William G Strang, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/341,330

(22) Filed: Jan. 27, 2006

(51) Int. Cl.
*H01R 4/10* (2006.01)

(52) U.S. Cl. ..... 439/877; 439/851; 439/843

(58) Field of Classification Search ..... 439/877, 439/852, 851, 842, 843, 878
See application file for complete search history.

(56) References Cited

U.S. PATENT DOCUMENTS

| | | | | |
|---|---|---|---|---|
| 3,601,783 | A * | 8/1971 | Loose | 439/730 |
| 3,713,080 | A | 1/1973 | Kennedy | |
| 5,281,175 | A | 1/1994 | Chupak et al. | |
| 5,480,320 | A | 1/1996 | Saimoto | |
| 5,529,517 | A * | 6/1996 | Hopf et al. | 439/843 |
| 5,540,603 | A | 7/1996 | Fujiwara | |
| 5,601,458 | A | 2/1997 | Ohsumi et al. | |
| 5,649,842 | A | 7/1997 | Ohsumi | |
| 5,681,190 | A * | 10/1997 | Childs | 439/856 |
| 5,716,245 | A * | 2/1998 | Kameyama et al. | 439/852 |
| 5,769,673 | A | 6/1998 | Ohta et al. | |
| 5,947,777 | A * | 9/1999 | Chaillot et al. | 439/852 |
| 6,083,034 | A * | 7/2000 | Kameyama | 439/394 |
| 6,142,816 | A * | 11/2000 | Kameyama | 439/394 |
| 6,428,365 | B1 | 8/2002 | Yamamoto | |
| 6,506,084 | B2 | 1/2003 | Saitoh | |
| 6,520,811 | B2 | 2/2003 | Mitani et al. | |
| 6,544,080 | B1 | 4/2003 | Yamamoto | |
| 6,736,684 | B2 | 5/2004 | Ishiyama | |
| 7,115,004 | B2 * | 10/2006 | Takayama | 439/852 |
| 2001/0002350 | A1 | 5/2001 | Kashiyama et al. | |
| 2002/0077001 | A1 | 6/2002 | Chen | |
| 2002/0155763 | A1 | 10/2002 | Saitoh | |
| 2003/0109181 | A1 | 6/2003 | Bungo | |
| 2004/0224573 | A1 | 11/2004 | Yoshida et al. | |
| 2005/0112958 | A1 | 5/2005 | Yagi et al. | |
| 2005/0153605 | A1 | 7/2005 | Anbo et al. | |
| 2006/0205289 | A1 * | 9/2006 | Kumakura | 439/866 |

OTHER PUBLICATIONS

U.S. Appl. No. 11/159,909, filed Jun. 23, 2005, John R. Morello.

* cited by examiner

*Primary Examiner*—Tho D. Ta
*Assistant Examiner*—Vanessa Girardi
(74) *Attorney, Agent, or Firm*—David P. Wood

(57) ABSTRACT

An improved box-shaped female electrical connector featuring an optimized conductive (electrical and thermal) path, a spring contact insensitive to deformation, minimization of male blade insertion force, and maximization of contact force with the blade, all made possible by inclusion of the following structural aspects: an optimized conductive path, a spring contact carried by a dual spring contact member operative interfaced with an over stress abutment, a spring contact shield at the mouth of the electrical connector, and a basal contact, disposed opposite the spring contact, which is part of the direct conductive path of the electrical connector.

8 Claims, 2 Drawing Sheets

FEMALE ELECTRICAL CONNECTOR HAVING CRIMPING PORTIONS OF DOUBLE THICKNESS

TECHNICAL FIELD

The present invention relates to electrical connectors, and more particularly to female electrical connectors including a spring contact and oppositely disposed basal contact for electrically interfacing with a male blade terminal. Still more particularly, the present invention relates to an electrical connector of the aforesaid class having an optimized conductive path.

BACKGROUND OF THE INVENTION

In the electrical arts, it has been the practice to provide a selectively separable electrical connection between first and second electrical circuits by mutually interfacing first and second electrical connectors, each being respectively connected to the first and second electrical circuits. In this regard, of particular interest are box-shaped female electrical connectors having an internally disposed resilient spring contact and opposingly disposed basal contact for engaging an inserted male blade. An interesting example of such an electrical connector is recounted in U.S. Pat. No. 5,281,175.

A number of concerns exist with respect to the aforementioned class of female electrical connectors, including: improving electrical conductivity of the conductive path; minimizing spring terminal deformation sensitivity; and minimizing male blade insertion force while concomitantly providing high contact force with respect thereto.

Accordingly, it would be most desirable if somehow a box-shaped female electrical connector could be devised wherein the conductive path is optimized, the spring contact terminal thereof is insensitive to deformation, male blade insertion is minimized and contact force with the male blade is maximized.

SUMMARY OF THE INVENTION

The present invention is an improved box-shaped female electrical connector featuring an optimized conductive (electrical and thermal) path, a spring contact insensitive to deformation, minimization of male blade insertion force, and maximization of contact force with the blade, all made possible by inclusion of the following structural aspects: an optimized conductive path, a spring contact carried by a dual spring contact member operatively interfaced with an over stress abutment, a spring contact shield at the mouth of the electrical connector, and a basal contact, disposed opposite the spring contact, which is part of the direct conductive path of the electrical connector, all of which allowing use of thinner connector body metal and enhanced connector performance.

The improved female electrical connector according to the present invention has a connector body integrally composed of a connector portion, a crimp portion, and a transition portion disposed therebetween. The connector portion includes has generally box-shape defining an interior cavity, and is characterized by an upper wall, an opposite lower wall and sidewalls extending therebetween. The forward end of the electrical connector body has a mouth into which a male blade is insertable. Disposed oppositely with respect to the mouth, at the distal end of the connector body, is the crimp portion, characterized by a first wire core crimp and a wire jacket crimp both integrally formed of the connector body.

A portion of the lower wall is folded 180 degrees back on itself at the mouth to thereby provide a leg disposed adjacent the lower wall of the electrical connector body. The distal end of the leg has an integrally formed second wire core crimp which is nested with respect to the first wire core crimp of the lower wall. The leg carries a basal contact, preferably provided by a raised land of the leg.

A dual spring contact member is composed of a spring arm which originates at a spring beam that is integrally connected to the electrical connector body, and is disposed in the interior cavity generally adjacent the mouth. A generally bow shaped primary spring carries a spring contact and is disposed between a primary nose and a secondary nose, wherein the spring contact is disposed opposite the basal contact of the leg. Connected to the secondary nose is a secondary spring having a distal end which abuts the upper wall.

A mouth shield is formed of the upper wall and serves to protect the primary nose of the dual spring contact member from insertional damage as a male blade terminal is inserted into the electrical connector body.

A lug depends from the upper wall, and serves as an abutment for the spring arm in the event the dual spring contact member is over stressed by a male blade that has been inserted through the mouth.

In operation, a male blade is inserted into the electrical connector body of the electrical connector through the mouth thereof, wherein, as the male blade is inserted, it slidingly abuts the spring contact and the opposing basal contact. The primary and secondary springs of the dual spring contact member are resiliently compressed by the male blade, thereby assuring a strong contact force between the male terminal and the spring and leg contacts, while the insertional force applied to the male blade is minimized.

The primary spring and the secondary spring perform independently of each other. Accordingly, in the event the primary spring should become damaged, as for example if the male blade terminal untowardly bent the primary spring, then the secondary spring will function normally and independently of the primary spring so as to provide excellent electrical contact of an inserted male blade with the spring contact.

The leg provides a direct electrical path between the second wire core crimp and the basal contact, whereby electrical resistance is minimal therebetween, and the combination of the leg and the lower wall provide an optimized conductive path for electricity and heat dissipation. Further the leg provides strengthening at the transition portion between the connector portion and the crimp portion of the connector body.

Accordingly, it is an object of the present invention to provide an improved box-shaped female electrical connector featuring an optimized conductive path, a spring contact insensitive to deformation, minimization of male blade insertion force, and maximization of contact force with the blade.

This and additional objects, features and advantages of the present invention will become clearer from the following specification of a preferred embodiment.

DESCRIPTION OF THE PREFERRED EMBODIMENT

Figure 1:
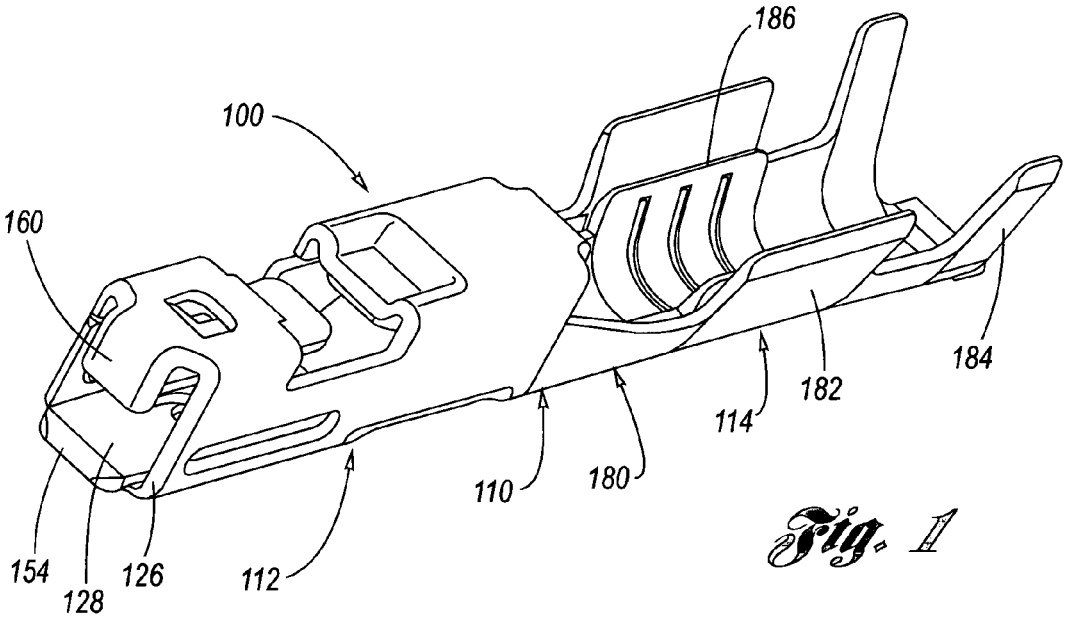
FIG. 1 is a perspective, forward facing view of an electrical connector according to the present invention.
Figure 2:
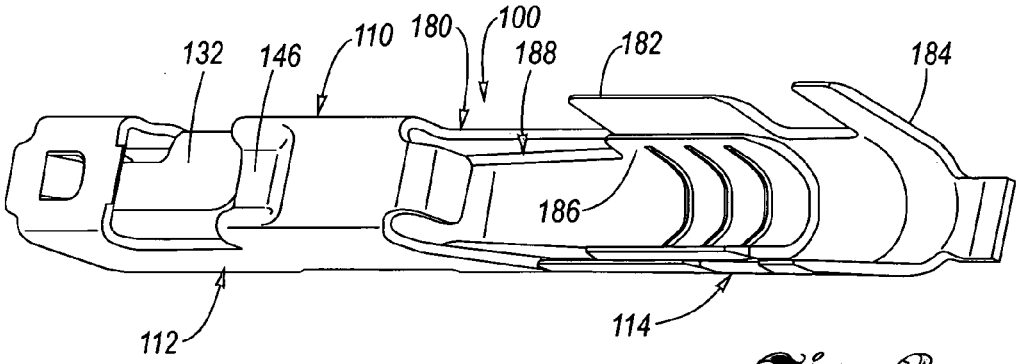
FIG. 2 is a perspective, rearward facing view of the electrical connector of FIG. 1.

Referring now to the Drawing, FIGS. 1 through 7 depict various aspects of an electrical connector 100 having a dual conductive (electrical and thermal) path in accordance with the present invention. The electrical connector 100 is formed of a single piece metal blank (see FIG. 7) which is formed into a connector body 110 (to be described hereinbelow), wherein the connector body has a connector portion 112 and a crimp portion 114 which are integrally interfaced via a transition portion therebetween, as further discussed hereinbelow.

The connector portion 112 has a generally box-shape defined by an upper wall 116, an opposite lower wall 118 and left and right sidewalls 120, 122 extending therebetween, collectively defining an interior cavity 124. A forward end 126 of the connector portion 112 has a mouth 128 for receiving a male blade (see for example FIG. 4) into the interior cavity 124.

Figure 3:
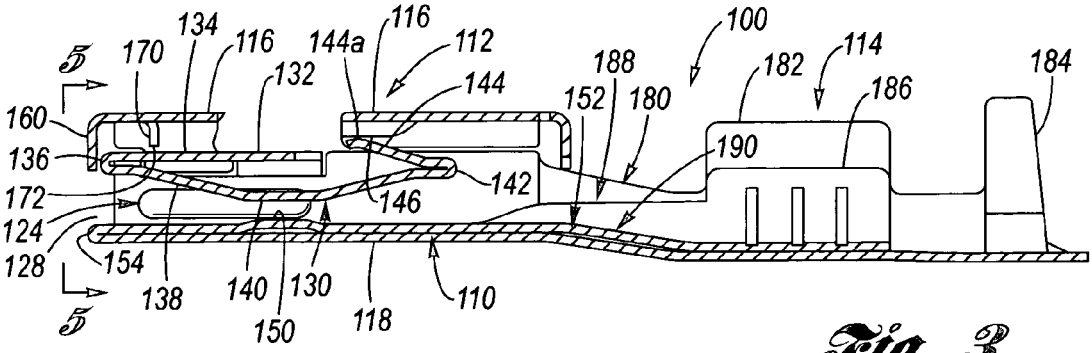
FIG. 3 is a longitudinal section view of the electrical connector of FIG. 1.

A dual spring contact member 130 is composed of a spring arm 132 which is integral with the connector body 110, wherein a spring beam 134 originates at the left sidewall 120 (or alternatively may originate at the right sidewall 122) at a location spaced from the mouth 128 (as seen best at FIG. 3). The spring beam 134 extends toward a primary nose 136 disposed adjacent the mouth 128. The primary nose 136 is defined by a first 180 degree bend in the spring arm 132. Connected to the primary nose 136, opposite the spring beam 134, is a generally bow shaped primary spring 138 which is disposed inside the interior cavity 124 and extends rearwardly from the mouth 128 in spaced relation from the upper and lower walls 116, 118. A medial portion of the primary spring 138 serves as a spring contact 140. Connected to the primary spring 138, opposite the primary nose 136, is a secondary nose 142. The secondary nose 142 is defined by a second 180 degree bend in the spring arm 132. Connected to the secondary nose 142, opposite the primary spring 138, is a secondary spring 144. The secondary spring 144 bends toward, and abuts at a terminus 144*a* thereof, the upper wall 116 of the connector portion 112.

Disposed oppositely with respect to the spring contact 140 of the dual spring contact member 130 is a basal contact 150, preferably in the form of a raised land. The basal contact 150 is formed of a leg 152. The leg 152 is integrally connected with the connector body 110 at the lower wall 118, wherein at the mouth 128, the leg is folded 180 degrees back on itself, thereby forming leg nose 154, whereby the leg is disposed in the interior cavity 124 adjacent the lower wall.

A mouth shield 160 is integrally connected with the upper wall 116 at the mouth 128 and is downwardly depending so as to partly occlude the mouth with respect to the primary nose 136 of the dual spring contact member 130. The mouth shield 160 serves to protect the primary nose 136 from possible damage by a male blade 164 as it is inserted into the interior cavity (see generally FIG. 4).

An overstress lug 170 is integrally connected with the upper wall 116 and depends therefrom in generally close proximity to the mouth 128. The overstress lug 170 terminates at a lug abutment 172 which is spaced in proximal relation to the spring beam 134. In the event of an overstress compression of the dual spring contact member 130 by insertion of a male blade, the spring beam 134 will abut the lug abutment 172 and thereby greatly stiffen the primary spring 138 at the primary nose 136 and thereby prevent the primary spring from exceeding its elastic limit where the spring beam 134 originates at the left sidewall 120 (or alternatively at the right sidewall 122).

The crimp portion 114 is integrally connected to the connector portion 112 at the lower wall 118 at a body transition portion 180. The crimp portion 112 includes a first wire core crimp 182 and a wire jacket crimp 184 both integrally formed of the connector body 110.

Distally from the mouth 128, the leg 152 forms a second wire core crimp 186 which is nested with respect to the first wire core crimp 182. There is a leg transition portion 188 of the leg 152 which is nested with respect to the body transition portion 180, wherein this nesting provides stiffening of the connector body 110 at the body transition portion 180, whereby metal thickness of the connector body (blank) may be reduced, ie., from, for example, 0.3 mm thickness to 0.2 mm thickness.

An optimized conductive path 198 for electrical and thermal conduction is provided by the leg 152 and the lower wall 118. The optimized conductive path 198 allows for minimal electrical resistance and excellent heat dissipation by the conductor body 110. A direct electrical path 190 is provided between the second wire core crimp 186 and the basal contact 150.

Additionally, the nested first and second wire core crimps provide a dual electrical path between a crimped wire core 192 of a wire 194 and the spring and leg contacts 140, 150 (see FIG. 4), whereby electrical resistance and Joule heating of the electrical connector 100, when in operation, is minimized even where the metal thickness has been reduced, as mentioned above.

Figure 7:
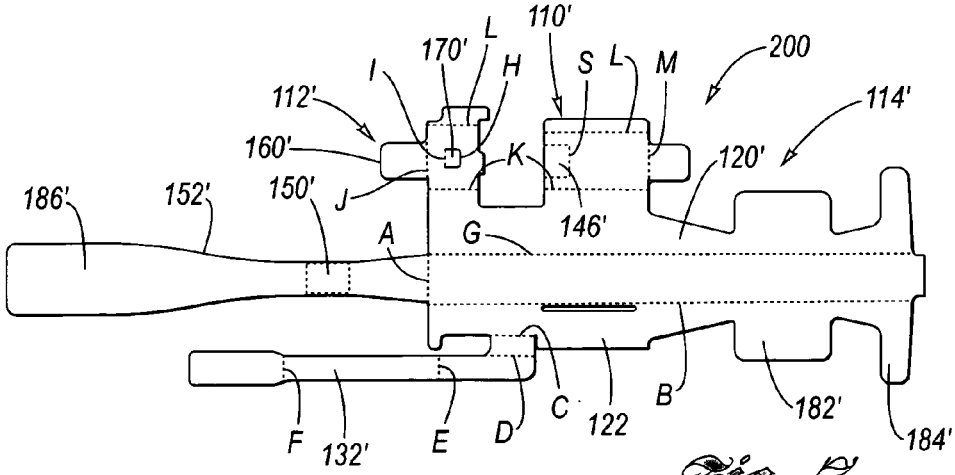
FIG. 7 is a plan view of a metal blank which is selectively bent to form the electrical connector according to the present invention.

Turning attention now with particularity to FIG. 7, seen is a single piece, die-cut metal blank 200 to which bending and stamping operations provide the aforedescribed connector body 110. In this regard, like parts as described above will be identified on the metal blank 200 with like numbers with a prime. The operations described below may not be performed in the order described.

The blank 200 includes the connector portion 112', the crimp portion 114' and body and leg transition portions 180', 188'. The connector portion 112' is formed by the leg 152' being stamped within stamp lines S1 to provide the raised land of the basal contact 150', and the distal end of the leg is bendingly provided with the second wire core crimp 186' and the leg transition portion 188'. The leg 152' is then bent 180 degrees back at fold A to form the above discussed leg nose. The right side wall 122 is formed by a 90 degree bend along fold B. The spring arm 132' is bent, including at folds C, D, E (forming the secondary nose) and F (forming the primary nose), with the spring contact 140' being located between folds E and F, to provide the above described dual contact spring member. The overstress lug 170' is formed by a die cut H and a 90 degree bend at fold I. The mouth shield 160' is formed by a 90 degree bend at fold J. The recessed spring abutment land 146' is provided by stamping within stamp lines S2. The left sidewall 120 is formed by a 90 degree bend at fold G, and the upper wall 116' is formed by a 90 degree bend at fold K. Bends of 90 degrees are provided at folds L and M. Finally, the connector body 110' is completed by bending to provide the first wire core crimp 182' and the wire jacket crimp 184'.

Figure 4:
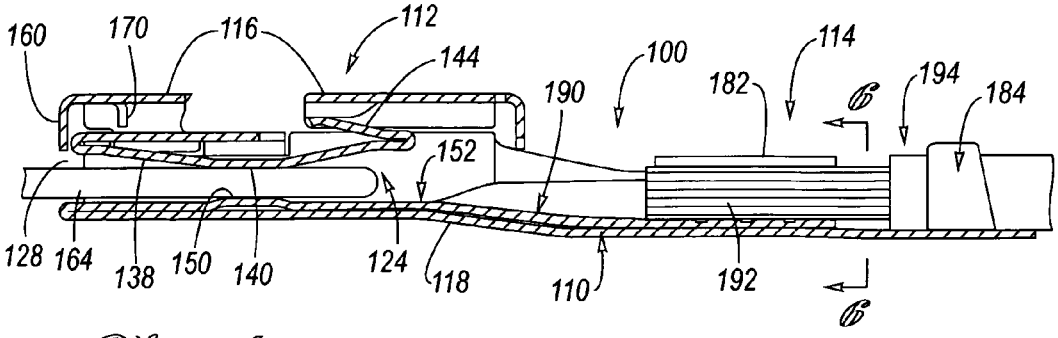
FIG. 4 is a sectional view of the electrical connector as in FIG. 3, now seen in operation with respect to a crimped wire core and an inserted male blade.
Figure 5:
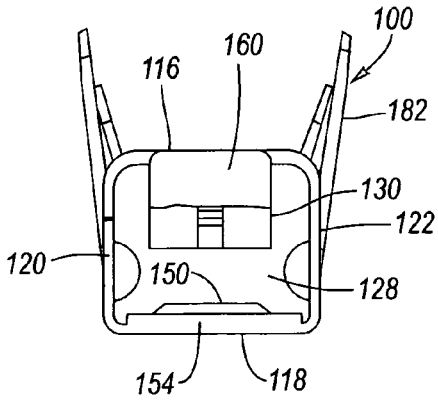
FIG. 5 is a partly broken-away front view of the electrical connector, seen along line 5-5 of FIG. 3.
Figure 6:
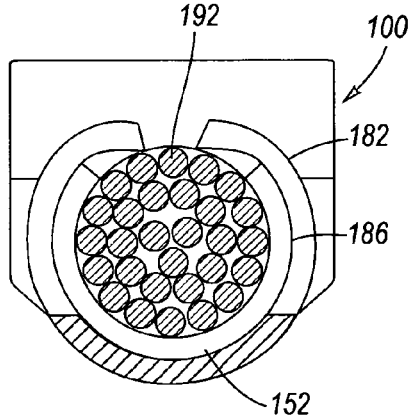
FIG. 6 is a sectional view of the electrical connector shown in operation, seen along line 6-6 of FIG. 4.

With particular reference to FIGS. 4 and 6, operation of the electrical connector 100 will now be detailed.

A male blade 164 is inserted into the conductor body 110 of the electrical connector 100 through the mouth 128 thereof, wherein, as the male blade is inserted, it abuts the spring contact 140 of the dual spring contact member 130 and the opposing basal contact 150 of the leg 152. The primary and secondary springs 138, 144 of the dual spring contact member are resiliently compressed, thereby assuring a strong contact force between the male terminal 164 and the spring and basal contacts 140, 150, while easing the insertional force of the male blade into the interior cavity 124.

The leg 152 provides a direct electrical path 190 between the second wire core crimp 186 and the basal contact 150, and, in combination with the lower wall 118 provides an optimized conductive path 198 for both electricity and heat, whereby electrical resistance and Joule heating are minimal, and any heat is readily dissipated by being conducted away throughout the conductor body 110. Further the leg provides strengthening at the body and leg transitions 180, 188 disposed between the connector portion 112 and the crimp portion 114 of the connector body 110.

The primary and secondary springs 130, 144 provide resilient location of the spring contact 140 independent of each other. In the event the primary spring 130 should become damaged, as for example by being bent by an untoward insertion of a male blade, then the undamaged secondary spring 144 will function normally and independently of the damaged primary spring so as to provide excellent electrical contact of the inserted male blade with the spring contact 140 and the basal contact 150. The primary and secondary springs 130, 144 allow accommodation for various thicknesses of male blades, which eliminates need for different sized electrical connectors for differing sized male blade terminals. The spring contact will compliantly follow the surface movement of the male blade, and the electrical contact therebetween is vibration insensitive.

It will be understood that the embodiment shown and described above with respect to an electrical connector having nested first and second wire core crimps is by way of exemplification only and not limitation. It is possible, for example, to connect the second wire core crimp to the connector body other than via a leg, as described and shown, such as for example by connection of the second wire core crimp to the upper wall, either or both of the left and right sidewalls, or otherwise with respect to the bottom wall.

To those skilled in the art to which this invention appertains, the above described preferred embodiment may be subject to change or modification. Such change or modification can be carried out without departing from the scope of the invention, which is intended to be limited only by the scope of the appended claims.

The invention claimed is:

1. A connector body of a female electrical connector, said connector body comprising:

a connector portion comprising:

an upper wall, an oppositely disposed lower wall and left and right sidewalls extending between said upper and lower walls, an interior cavity being defined between said upper and lower walls, said electrical connector body having a mouth communicating with said interior cavity;

a basal contact located in said interior cavity connected with said connector body; and a spring contact member comprising a spring arm connected with said electrical connector body and disposed in said interior cavity, a spring contact being carried by said spring arm, said spring contact being disposed opposite said basal contact;

a crimp portion comprising:

a first wire core crimp connected with said lower wall; and a second wire core crimp nested with respect to said first wire core crimp; and a leg connected to said lower wall at a leg nose defined by a bend in said leg substantially at said mouth and generally disposed adjacent said lower wall, said basal contact and said second wire core crimp being carried by said leg;

wherein said leg provides a direct electrical path between said second wire core crimp and said basal contact.

2. The connector body of claim 1, further comprising:

a body transition portion disposed between said connector portion and said first wire crimp of said crimp portion; and a leg transition portion nested with respect to said body transition portion.

3. The connector body of claim 2, wherein said spring contact member comprises a dual spring contact member comprising:

a spring beam originating at one of said left and right sidewalls;

a primary nose connected with said spring beam adjacent said mouth, said primary nose being defined by a first substantially 180 degree bend in the spring arm;

a generally bow shaped primary spring connected to said primary nose and disposed inside said interior cavity in spaced relation with respect to said upper and lower walls, wherein a spring contact is located at a medial portion of said primary spring;

a secondary nose connected to said primary spring opposite with respect to the primary nose, said secondary nose being defined by a second substantially 180 degree bend in the spring arm; and a secondary spring connected to said secondary nose, said secondary spring having a terminus abutting said upper wall.

4. The connector body of claim 3, wherein said primary and secondary springs provide resilient location of said spring contact independently of each other.

5. The connector body of claim 3, further comprising:

an overstress lug connected with said connector body, said overstress lug having a lug abutment proximally spaced with respect to said spring beam;

wherein resilient compression of said primary spring is regulated by abutment of said lug abutment with said spring beam.

6. The connector body of claim 3, further comprising a shield connected to said connector body, said shield being disposed at said mouth in partial occlusion thereof, wherein the partial occlusion generally occludes the primary nose.

7. The connector body of claim 6, further comprising:

an overstress lug connected with said connector body, said overstress lug having a lug abutment proximally spaced with respect to said spring beam;

wherein resilient compression of said primary spring is regulated by abutment of said lug abutment with said spring beam.

8. The connector body of claim 7, wherein said primary and secondary springs provide resilient location of said spring contact independently of each other.

* * * * *